US005336117A

United States Patent [19]

Mizuguchi et al.

[11] Patent Number: 5,336,117

[45] Date of Patent: Aug. 9, 1994

[54] SPLIT TPE CARD-EDGE CONNECTOR

[75] Inventors: Osamu Mizuguchi; Teruyuki Mori, both of Kanagawa, Japan

[73] Assignee: Kyocera Elco Corporation, Kanagawa, Japan

[21] Appl. No.: 68,103

[22] Filed: May 28, 1993

[30] Foreign Application Priority Data

Sep. 21, 1992 [JP] Japan ..... 4-065594[U]

[51] Int. Cl.[5] ..... H01R 9/22

[52] U.S. Cl. ..... 439/717; 439/374

[58] Field of Search ..... 4439/79, 701, 686, 687, 4439/690, 80, 374

[56] References Cited

U.S. PATENT DOCUMENTS

| | | | |
|---|---|---|---|
| 4,659,155 | 4/1987 | Walkup et al. | 439/79 |
| 4,887,353 | 12/1989 | Preputnick | 439/79 |
| 4,898,549 | 2/1990 | Nakama et al. | 439/701 |
| 4,909,743 | 3/1990 | Johnson et al. | 439/79 |
| 5,030,113 | 7/1991 | Wilson | 439/80 |

FOREIGN PATENT DOCUMENTS

| | | | |
|---|---|---|---|
| 342873 | 11/1989 | European Pat. Off. | 439/79 |

*Primary Examiner*—David L. Pirlot

[57] ABSTRACT

A split type card-edge connector including a pair of identical connector halves, each having contacts to be connected to corresponding terminals provided on opposite surfaces of a substrate, and securing members which secure the connector halves when the respective contacts are connected to the corresponding terminals of the substrate.

24 Claims, 7 Drawing Sheets

SPLIT TPE CARD-EDGE CONNECTOR

BACKGROUND OF THE INVENTION

1. Field of the Invention

The present invention relates to a card-edge connector which is connected to front and back terminals provided on front and back surfaces of a substrate at an edge thereof.

2. Description of Related Art

In a known card-edge connector having contacts which are to be connected to terminals of a substrate, the contacts can be elastically deformed by the substrate; or they may scrape the terminal coating off when the connector is connected to the edge of the substrate. To prevent this, for example, Japanese Examined Utility Model (Kokoku) Publication No. 3-47264 discloses a card-edge connector having a pair of split connector halves, each having contacts to which terminals provided on front and back surfaces of a substrate are to be connected, so that the connector halves can be interconnected while the contacts are in contact with the associated terminals.

Nevertheless, in the known card-edge connector, the connector halves are not identical in shape, thus resulting in increased manufacturing cost and difficult maintenance thereof.

SUMMARY OF THE INVENTION

The primary object of the present invention is to provide a card-edge connector having a pair of split connector halves, which can be inexpensively manufactured and easily maintained.

The basic concept of the present invention resides in the provision of identical connector halves to reduce manufacturing costs and simplify the maintenance thereof.

According to the present invention, there is provided a split type card-edge connector comprising a pair of identical connector halves, each having contacts to be connected to corresponding terminals provided on opposite surfaces of a substrate, and a securing means for securing the connector halves together when the respective contacts are connected to the corresponding terminals of the substrate.

Preferably, a heat dissipating means is provided in each of the connector halves.

According to another aspect of the present invention, there is provided a connector apparatus comprising a receptacle connector having contacts to be connected to corresponding terminals provided on opposite sides of a first substrate, a plug connector having contacts to be connected to corresponding terminals of a second substrate, said plug connector being connected to the receptacle connector, and a heat dissipating (radiating) passage provided on at least one of the receptacle connector and the plug connector to dissipate heat generated at connecting portions of the contacts.

According to still another aspect of the present invention, there is provided a connector apparatus comprising a receptacle connector having contacts to be connected to corresponding terminals provided on opposite sides of a first substrate, and a plug connector having contacts to be connected to corresponding terminals of a second substrate, said plug connector being connected to the receptacle connector, wherein said plug connector is provided, on the portions thereof that are to be connected to the contacts of the receptacle connector, with planar connecting portions, and said receptacle connector is provided, on the portions thereof that are to be connected to the planar connecting portions of the plug connector, with elastically deformable legs which come into elastic contact with the planar connecting portions, respectively.

According to still another aspect of the present invention, there is provided a connector apparatus comprising a receptacle connector having contacts to be connected to corresponding terminals provided on opposite sides of a substrate, a positioning recess provided on the substrate to position the receptacle connector, and a positioning projection provided on the receptacle connector to be fitted in the positioning recess.

According to the present invention, provision is also made for a split type card-edge connector comprising a pair of identical connector halves, each having contacts to be connected to corresponding terminals provided on opposite sides of a substrate, said connector halves defining together a recess in which the end of the substrate can be fitted when the connector halves are interconnected, and provisional securing means provided on the connector halves to engage with each other when the connector halves are interconnected, and means for allowing the connector halves to slightly and relatively move when the the connector halves are interconnected.

The present disclosure relates to subject matter contained in Japanese utility model application No. 4-65594 (filed on Sep. 21, 1992) which is expressly incorporated herein by reference in its entirety.

BRIEF DESCRIPTION OF THE DRAWINGS

The invention will be described below in detail with reference to the accompanying drawings, in which.

DESCRIPTION OF THE PREFERRED EMBODIMENT

Figure 1:
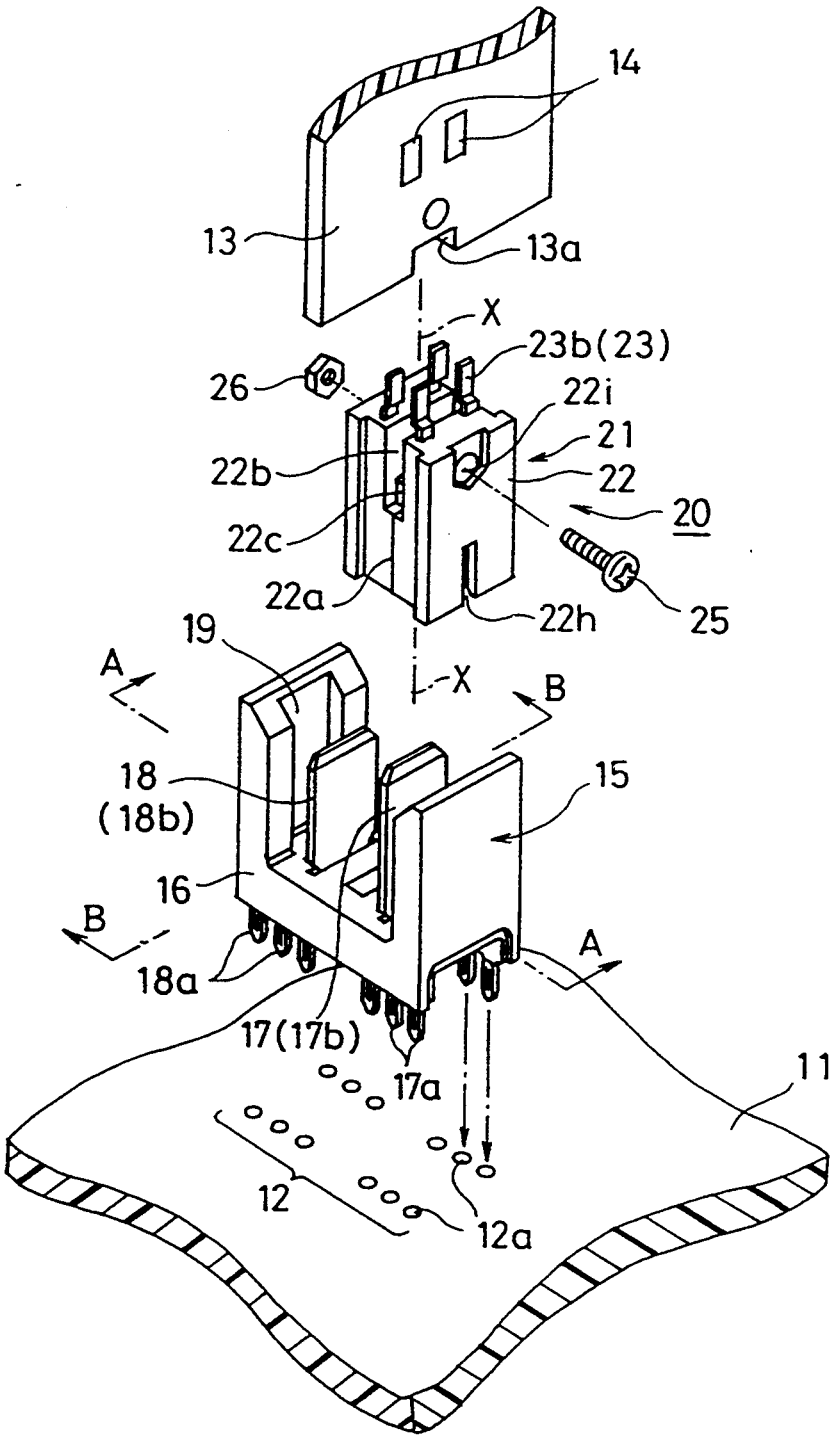
FIG. 1 is an exploded isometric view of a card-edge connector and a plug connector which are to be interconnected, according to the present invention.
Figure 2:
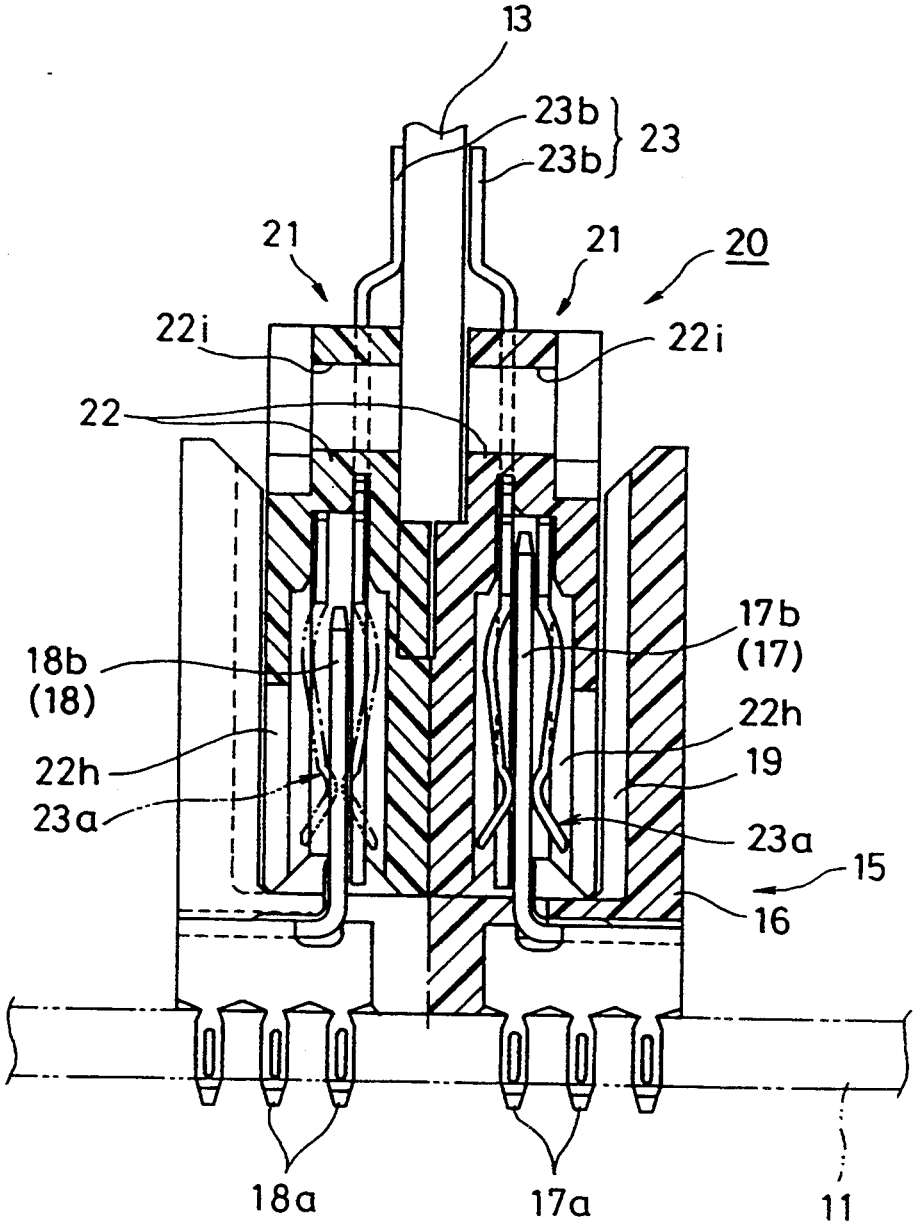
FIG. 2 is a sectional view taken along the line A—A in FIG. 1, showing a connection between a card-edge connector and a substrate, according to the present invention.
Figure 3:
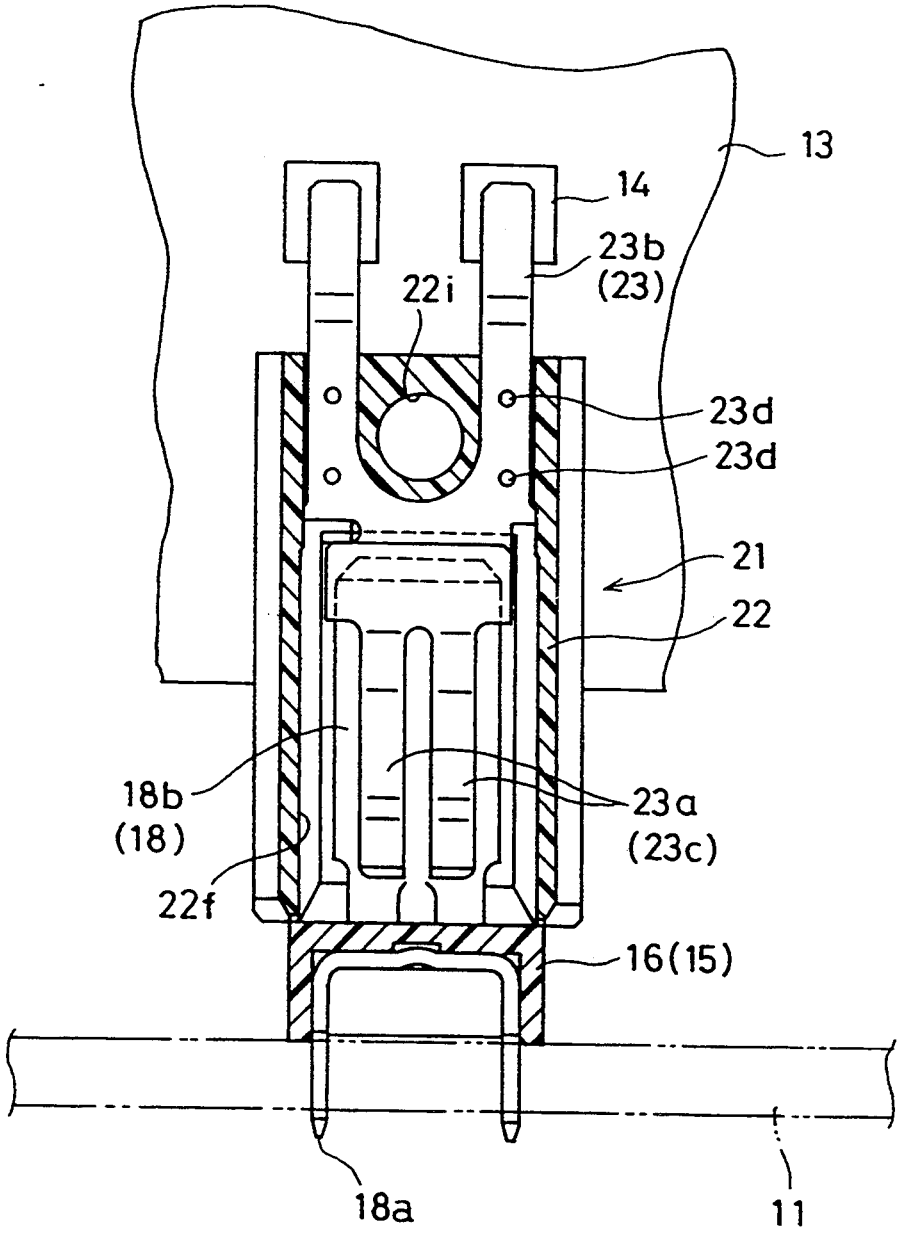
FIG. 3 is a sectional view taken along the line B—B in FIG. 1.
Figure 4:
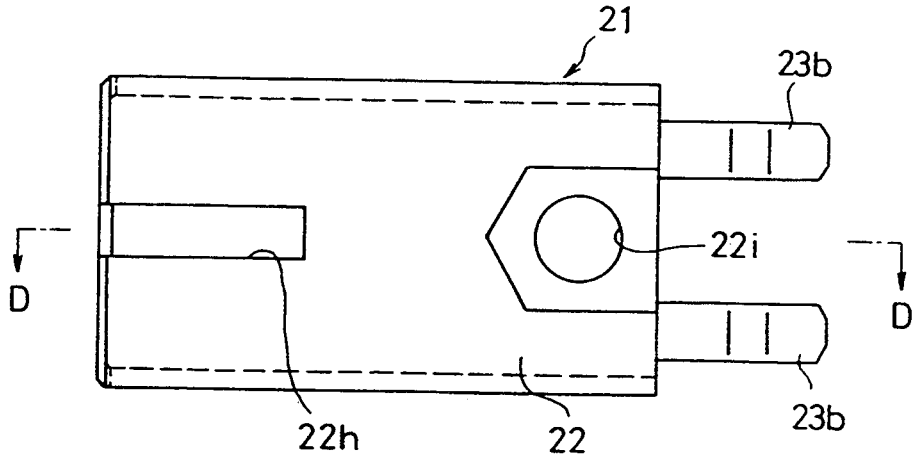
FIG. 4 is a plan view of a connector half which constitutes a card-edge connector, according to the present invention.

In the illustrated embodiment, to connect power terminals 12 provided on a first substrate 11 to power terminals 14 provided on a second substrate 13, a plug connector 15 is connected to the first substrate 11 and a card-edge connector 20 according to the present invention is connected to the second substrate 13, so that the card-edge connector 20 can be connected to the plug connector 15.

The plug connector 15 includes a housing 16 of synthetic resin which is provided thereon with plug contacts which include a grounding contact 17 and a power source contact 18. The plug contacts 17 and 18 are provided with legs 17*a* and 18*a* which can be inserted in corresponding through holes 12*a* of the power terminals 12 of the first substrate 11, and wide tab plates 17*b* and 18*b* to be connected to the card-edge connector 20, respectively. The grounding tab plate 17*b* is longer than the power source tab plate 18*b*, so that upon connection of the plug connector 15 to the card-edge connector 20, the grounding tab plate 17*b* is connected to the card-edge connector 20 prior to the connection between the card-edge connector and the power source tab plate 18*b*. The housing 16 is provided with heat dissipating grooves 19 formed on the inner surfaces thereof opposed to the plug contacts 17 and 18.

The card-edge connector 20 is comprised of a pair of identical connector halves 21 which are interconnected at a connecting surface 22*a*. Each connector half 21 has a housing 22 of synthetic resin and receptacle contacts 23 which are press-fitted in the housing 22. The housing 22 is provided on the connecting surface 22*a* thereof with a recess 22*b* opening into the side of the housing 22 adjacent to the second substrate 13 and a positioning projection 22*c* in the recess 22*b*. When the connector halves 21 are assembled, the recesses 22*b* of the housings 22 define an opening between the housings 22, so that the second substrate 13 can be inserted in the opening. The second substrate 13 is provided with a positioning recess 13*a* in which a projection defined by the pair of positioning projections 22*c* can be fitted.

Figure 5:
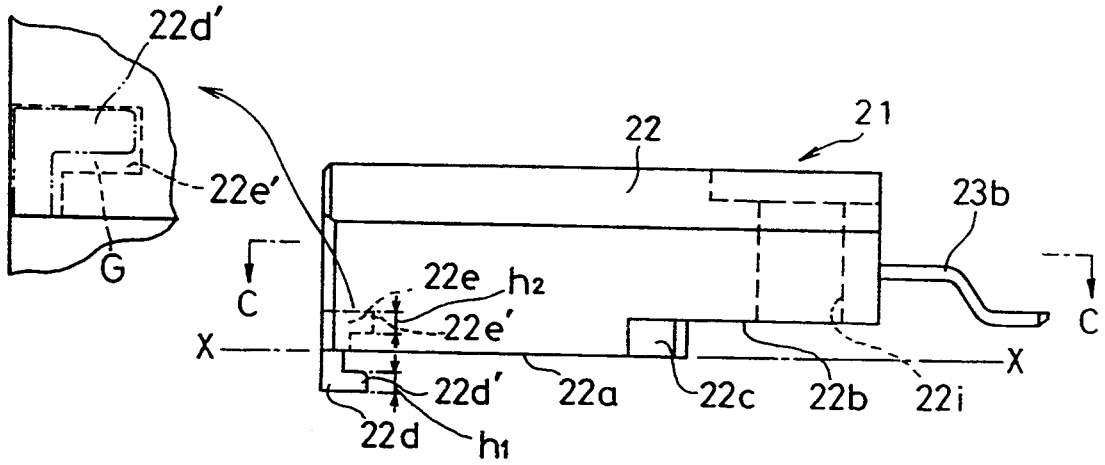
FIG. 5 is a front elevational view of the connector half shown in FIG. 4.
Figure 6:
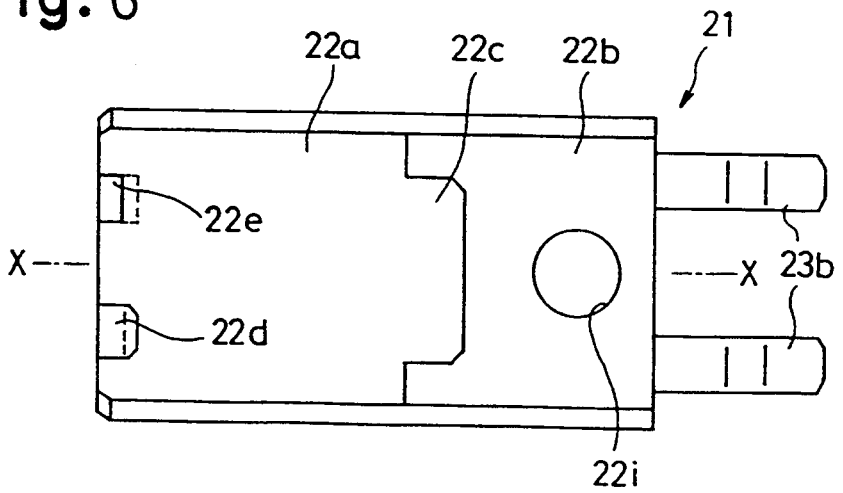
FIG. 6 is a bottom view of the connector half shown in FIG. 4.
Figure 7:
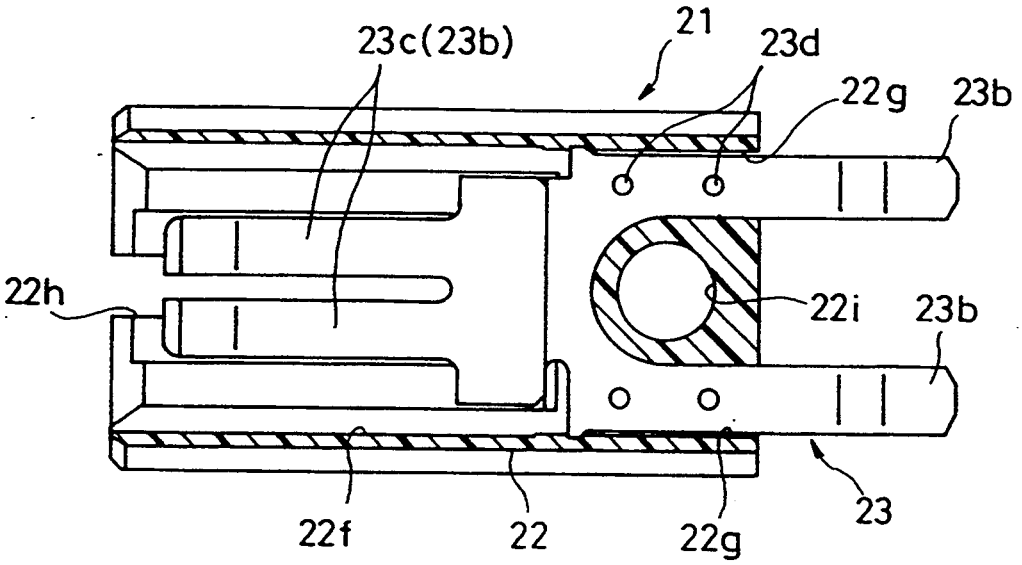
FIG. 7 is a sectional view taken along the line C—C in FIG. 5.
Figure 8:
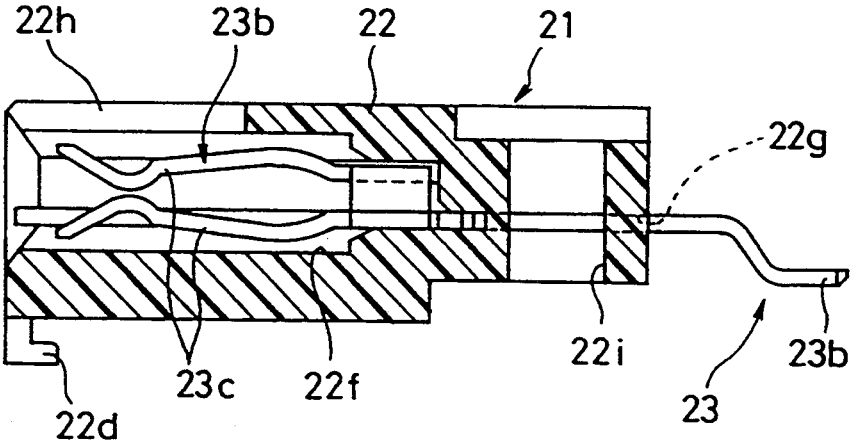
FIG. 8 is a sectional view taken along the line D—D in FIG. 4.
Figure 9:
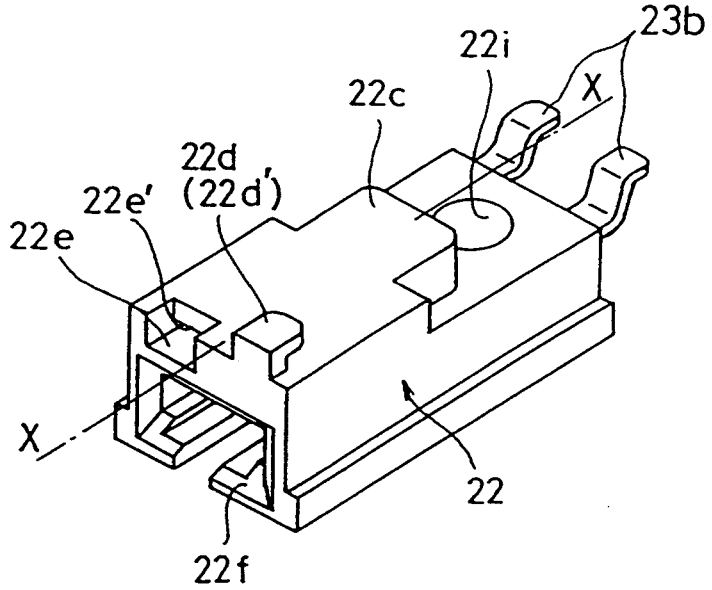
FIG. 9 is an isometric view of a connector half having an engaging book and a recess, according to the present invention.
Figure 10:
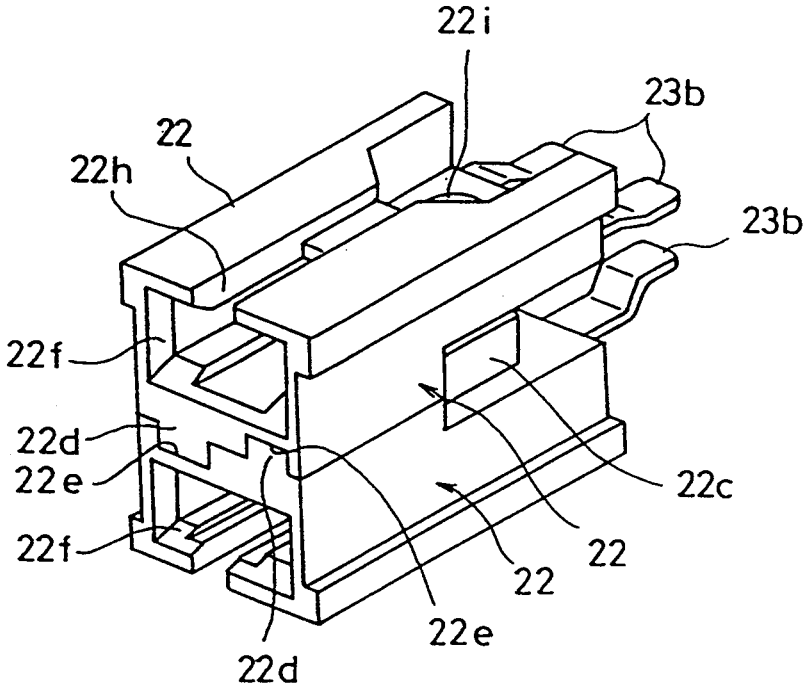
FIG. 10 is an isometric view of a card-edge connector having a pair of connector halves connected to each other, according to the present invention.
Figure 11:
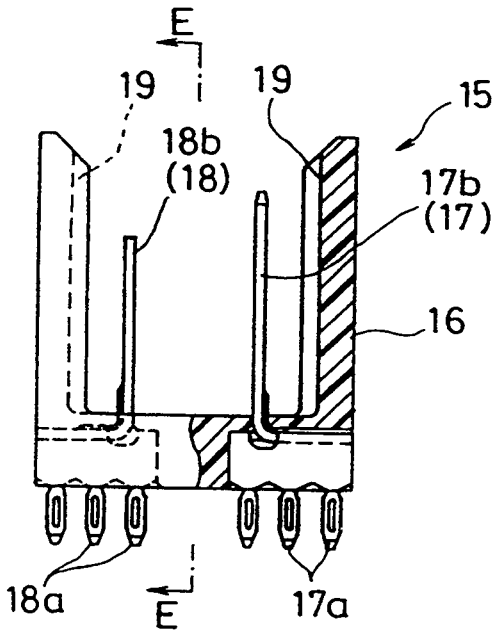
FIG. 11 is a longitudinal sectional view of a plug connector shown in FIG. 1; and, FIG. 12 is a sectional view taken along the line E—E in FIG. 11.
Figure 12:
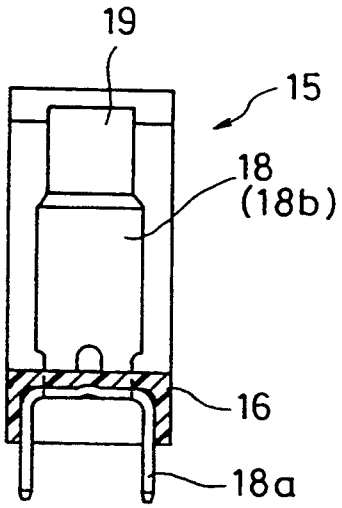

Each of the housings 22 is provided, on the end surface adjacent to the first substrate 11, with an engaging recess 22*e* and an engaging hook 22*d* on the connecting surface 22*a*. The engaging recess 22*e* and the engaging hook 22*d* are positioned symmetrically with respect to a center axis X'X of the connecting surface 22*a*. The recess 22*e* has a lateral recess portion 22*e'* and the engaging hook 22*d* has a corresponding lateral projection 22*d'*, respectively. The thickness $h_1$ of the lateral projection 22*d'* of the engaging hook 22*d* is smaller than the depth $h_2$ of the corresponding lateral recess portion 22*e'* of the engaging recess 22*e* ($h_1 < h_2$), as can be seen in FIG. 5.

The housings 22 have chambers 22*f* in which receptacle portions 23*a* of the associated receptacle contacts 23 are received, and grooves 22*g* in which the legs 23*b* of the receptacle contacts 23 are press-fitted. The chambers 22*f* are provided, on the inner walls thereof far from the connecting surface 22*a*, with heat dissipating passages (grooves) 22*h*.

The bent receptacle contacts 23 having the receptacle portions 23*a* and the connecting legs 23*b* are mass-produced by pressing a metal plate into a predetermined shape. Each receptacle portion 23*a* has a pair of elastically deformable legs 23*c* which are elastically brought into contact with the front and back surfaces of the associated plug contact 17 or 18. Each connecting leg 23*b* has a pair of bifurcated leg portions which are press-fitted in the corresponding spaced grooves 22*g*. The connecting legs 23*b* are provided with small projections 23*d* which ensure a press-fit of the connecting legs 23*b* in the corresponding spaced grooves 22*g*.

The housings 22 are provided with a pair of screw holes 22*i* which are located between the bifurcated connecting legs 23*b* and which are aligned when the housings 22 are assembled, so that a set screw 25 can be inserted in the aligned screw holes 22*i*. The bifurcated connecting legs 23*b* are symmetrical with respect to the center axis of the holes 22*i*.

The card-edge connector 20 as constructed above is assembled as follows. The connecting surfaces 22*a* of the connector halves 21 are opposed and connected to each other so that the engaging hooks 22*d* are fitted in the corresponding engaging recesses 22*e*. Since the thickness $h_1$ (FIG. 5) of the projections 22*d'* of the engaging hooks 22*d* is smaller than the depth $h_2$ of the recess portions 22*e'* of the engaging recesses 22*e* ($h_1 < h_2$), as mentioned above, there is a gap G ( FIG. 5 ) therebetween when the engaging hooks 22*d* are fitted in the corresponding engaging recesses 22*e*. Consequently, the engaging hooks 22*d* are movable by a displacement corresponding to the gap G in the associated engaging recesses 22*e* even after the engaging hooks 22*d* are fitted in the corresponding engaging recesses 22*e*. Namely, the connector halves 21 are relatively movable even after the engaging hooks 22*d* are fitted in the corresponding engaging recesses 22*e*. In other words, one of the connector halves 21 can be slightly moved away from the other connector half at one end (right end in FIG. 5) thereof adjacent to the connecting legs 23*b* without completely disengaging the engaging hooks 22*d* from the associated engaging recesses 22*e*. Consequently, the connecting legs 23*b* can be easily brought into contact with the power terminals 14 of the second substrate 13 due to the slight separation of the connector halves 21 at the right ends thereof. The separation of the connector halves 21 at the right ends thereof ensures an easy insertion of the second substrate 13 into the opening defined by the recesses 22*b* of the connector halves 21 without slide resistance between the connecting legs 23*b* and the power terminals 14 of the second substrate 13.

Thereafter, the bifurcated connecting legs 23*b* of the connector halves 21 are brought into contact with the power source terminals 14 on the front and rear surfaces of the second substrate 13. After that, the set screw 25 is inserted in the aligned screw holes 22*i* of the connector halves 21 and fastened by a nut 26, so that the card-edge connector 20 can be secured to the edge of the second substrate 13. During the fastening operation of the set screw 25, the positioning projections 22*c* of the connector halves 21 are fitted in the recess positioning recess 13*a* of the second substrate 13, so that relative movement between the connector halves and the second substrate does not occur. Before or during the fastening operation, the bifurcated connecting legs 23*b* of the connector halves 21 are soldered to the power terminals 14 of the second substrate 13 (in a surface mount method).

On the other hand, the legs 17*a* and 18*a* of the plug connector 15 are inserted in and soldered to the corresponding through holes 12*a* of the power terminals 12 of the first substrate 11. The card-edge connector 20 which has been connected to the second substrate 13 at the edge thereof is then connected to the plug connector 15. Namely, the plug contacts 17 and 18 are inserted in the chambers 22*f* of the housings 22, so that the tab plates 17*b* and 18*b* of the plug contacts 17 and 18 are inserted between and electrically connected to the receptacle portions 23*a* within the chambers 22*f*. Since each receptacle portion 23*a* has a pair of elastically deformable legs 23*c* on opposite sides thereof, even if one of them is permanently deformed, the electrical connection is still established.

The heat dissipating grooves 19 and 22*h* provided on the plug connector 15 and the housings 22 of the card-edge connector 20 effectively dissipate the heat of the power terminals. Namely, the contacts 23*a*, 17*b* and 18*b* are exposed to the aligned heat dissipating grooves 19 and 22*h*, and accordingly, the heat generated at the connection of the contacts 23*a*, 17*b* and 18*b* can be effectively radiated through the heat dissipating grooves 19 which open into the atmosphere.

As can be understood from the above discussion, according to the present invention, since the card-edge connector is comprised of a pair of identical connector halves, the manufacturing cost thereof can be reduced and the maintenance thereof can be simplified in comparison with the prior art in which the card-edge connector is constituted by different connector halves.

Furthermore, if the connector halves are rotationally symmetric with respect to the axis passing through the center of the connecting surfaces (mating surfaces) of the connector halves, it is possible to provide each connector half with an engaging hook and an engaging recess in which the engaging hook can be engaged to provisionally connect the connector halves.

If the card-edge connector of the present invention is used as a power supply connector, the connector halves can be used as receptacle connectors, and the plug connector which is to be connected to the receptacle connectors can be connected to a substrate. To effectively dissipate the heat of the power terminals, heat dissipating passages can be provided in the connector halves and the plug connector.

We claim:

1. A split type card-edge connector comprising a pair of identical connector halves, each having contacts to be connected to corresponding terminals provided on opposite surfaces of a substrate, and a securing means for securing the connector halves together when the respective contacts are connected to the corresponding terminals of the substrate, said connector halves comprising a provisional securing means for provisionally securing the connector halves so as to be slightly movable relative to each other so that the connector halves can be separated from one another, and said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

2. A split type card-edge connector according to claim 1, wherein said provisional securing means comprises engaging recesses and engaging hooks which can be engaged in the corresponding engaging recesses provided on the connector halves.

3. A split type card-edge connector according to claim 1, wherein the contacts of the connector halves are those for power supply.

4. A split type card-edge connector according to claim 1, wherein each of said connector halves is rotationally symmetric with respect to a center axis of mating surfaces of the connector halves to be connected.

5. A split type card-edge connector according to claim 4, wherein each of said connector halves comprises an engaging recess and an engaging hook which can be engaged in the engaging recess.

6. A split type card-edge connector according to claim 5, wherein said connector halves are capable of separating from each other when the engaging hook of one of the connector halves is engaged in the corresponding engaging recess of the other connector half.

7. A split type card-edge connector according to claim 1, wherein said connector halves together define a receptacle connector which can be connected to a plug connector connected to a substrate.

8. A split type card-edge connector according to claim 7, further comprising a heat dissipating means.

9. A split type card-edge connector according to claim 8, wherein said heat dissipating means comprises a heat dissipating passage provided on the receptacle connector and the plug connector.

10. A split type card-edge connector according to claim 9, wherein said securing means comprises a set bolt extending through the connector halves and the substrate to be connected to the connector halves.

11. A connector apparatus comprising a receptacle connector defined by a pair of connector halves and having contacts to be connected to corresponding terminals provided on opposite sides of a first substrate; a plug connector having contacts to be connected to corresponding terminals of a second substrate, said plug connector being connected to the receptacle connector; and, a heat dissipating passage provided on at least one of the receptacle connector and the plug connector to dissipate heat generated at connecting portions of the contacts, said connector halves comprising a provisional securing means for provisionally securing the connector halves so as to be slightly movable relative to each other so that the connector halves can be separated from one another, and said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

12. A connector apparatus according to claim 11, wherein said contacts are exposed to the heat dissipating passage which at least partially opens into the air.

13. A connector apparatus according to claim 12, wherein the contacts are those for power supply.

14. A connector apparatus comprising a receptacle connector defined by a pair of connector halves and having contacts to be connected to corresponding terminals provided on opposite sides of a first substrate, a plug connector having first contacts to be connected to corresponding terminals of a second substrate and second contacts to be connected to the contacts of the receptacle connector, which second contacts have planar connecting portions, said receptacle connector being provided, on the portions thereof that are to be connected to the planar connecting portions of the plug connector, with elastically deformable legs which come into elastic contact with the planar connecting portions, and said connector halves comprising a provisional securing means for provisionally securing the connector halves so as to be slightly movable relative to each other so that the connector halves can be separated from one another, said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

15. A connector apparatus comprising a receptacle connector defined by a pair of connector halves and having contacts to be connected to corresponding terminals provided on opposite sides of a substrate; a positioning recess provided on the substrate to position the receptacle connector; and, a positioning projection provided on the receptacle connector to be fitted in the positioning recess, said connector halves comprising a provisional securing means for provisionally securing the connector halves so as to be slightly movable relative to each other so the the connector halves can be separated from one another, and said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

16. A connector apparatus according to claim 15, said receptacle connector comprises a pair of identical connector halves, each having contacts to be connected to the corresponding terminals of the substrate, and a securing means for securing the connector halves when the respective contacts are connected to the corresponding terminals of the substrate.

17. A split-type card-edge connector comprising a pair of connector halves, each having contacts to be connected to corresponding terminals provided on opposite sides of a substrate, said connector halves together defining a recess in which the edge of the substrate can be fitted when the connector halves are interconnected, and provisional securing means provided on the connector halves to engage with each other when the connector halves are interconnected, and provisional securing means for allowing the connector halves to slightly and relatively move when the connector halves are interconnected, said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

18. A split-type card-edge connector according to claim 17, further comprising an immovable securing means for immovably securing the connector halves.

19. A split-type card-edge connector according to claim 18, wherein said connector halves are provided with insertion through holes which are aligned along a line when the connector halves are interconnected.

20. A split-type card-edge connector according to claim 19, wherein said immovably securing means comprises a set bolt which can be inserted in the through holes and a nut which can be screw-engaged by the set bolt to fasten the latter.

21. A split-type card-edge connector comprising a pair of identical connector halves, each having contacts to be connected to corresponding terminals provided on opposite sides of a substrate, said connector halves together defining a recess in which the edge of the substrate can be fitted when the connector halves are interconnected, and provisional securing means provided on the connector halves to engage with each other when the connector halves are interconnected, and means for allowing the connector halves to slightly and relatively move when the connector halves are interconnected, and an immovable securing means for immovably securing the connected halves, said connector halves being provided with insertion through holes which are aligned along a line when the connector halves are interconnected, said immovable securing means comprising a set bolt which can be inserted in the through holes and a nut which can be screw-engaged by the set bolt to fasten the latter, said provisional securing means comprising at least a pair of male and female members provided on each of the connector halves, so that when the connector halves are interconnected, the male member of one of the connector halves can be loosely fitted in the female member of the other connector half so as to allow the connector halves to slightly and relatively move.

22. A split-type card-edge connector according to claim 21, wherein said male and female members are constituted by predetermined shapes of hooks and recesses, respectively.

23. A split-type card-edge connector according to claim 22, wherein the engagement of the corresponding male and female members permits the connector halves to relatively move in a direction away from one another.

24. A split-type card-edge connector according to claim 23, wherein the connector halves define therebetween a recess in which the substrate can be fitted when the connector halves are interconnected.

* * * * *

UNITED STATES PATENT AND TRADEMARK OFFICE

CERTIFICATE OF CORRECTION

PATENT NO. : 5,336,117

DATED : August 9, 1994

INVENTOR(S) : Osamu Mizuguchi; et al.

It is certified that error appears in the above-identified patent and that said Letters Patent is hereby corrected as shown below:

On the title page: Item [54] and Column 1, line 1,

--[54]: SPLIT TYPE CARD-EDGE CONNECTOR--

Column 1, line 2, of the specification of the patent should read:

--SPLIT TYPE CARD-EDGE CONNECTOR--

Signed and Sealed this

Eighteenth Day of October, 1994

*Attest:*

*Attesting Officer*

Bruce Lehman

BRUCE LEHMAN

*Commissioner of Patents and Trademarks*